US009260904B1

(12) United States Patent
Gutierrez

(10) Patent No.: US 9,260,904 B1
(45) Date of Patent: Feb. 16, 2016

(54) CONCEALED VALUABLE-STORAGE BOX

(71) Applicant: Edwardo Gutierrez, Mesa, AZ (US)

(72) Inventor: Edwardo Gutierrez, Mesa, AZ (US)

( * ) Notice: Subject to any disclaimer, the term of this patent is extended or adjusted under 35 U.S.C. 154(b) by 0 days.

(21) Appl. No.: 14/198,747

(22) Filed: Mar. 6, 2014

Related U.S. Application Data

(60) Provisional application No. 61/791,016, filed on Mar. 15, 2013.

(51) Int. Cl.

| | |
|---|---|
| ***E05G 1/026*** | (2006.01) |
| ***E05G 1/04*** | (2006.01) |
| ***E05G 1/02*** | (2006.01) |
| *E05G 1/024* | (2006.01) |

(52) U.S. Cl.
CPC .. *E05G 1/02* (2013.01); *E05G 1/04* (2013.01); *E05G 1/024* (2013.01); *E05G 1/026* (2013.01); *E05G 2700/02* (2013.01)

(58) Field of Classification Search
CPC ..... E05G 1/00; E05G 1/02; E05G 1/04; E05G 1/005; E05G 1/024; E05G 1/026; E05G 2700/00; E05G 2700/02; A47B 67/02; A47B 2067/025
USPC ..... 70/DIG. 81, 63, 158, 163, 164, 70/170–173; 109/22, 23, 50, 52, 54, 73, 109/51, 58, 59 R, 64; 292/39; 248/551–553; 312/204
See application file for complete search history.

(56) References Cited

U.S. PATENT DOCUMENTS

| | | | | | |
|---|---|---|---|---|---|
| 85,647 | A | * | 1/1869 | Dolan | 109/73 |
| 456,010 | A | * | 7/1891 | Brittain | 109/23 |
| 968,536 | A | * | 8/1910 | Brucklacher | 109/50 |
| 1,060,241 | A | * | 4/1913 | Farnsworth | 109/23 |
| 1,404,480 | A | * | 1/1922 | Rauwald et al. | 109/50 |
| 2,139,909 | A | * | 12/1938 | Park | 109/47 |
| 2,798,445 | A | * | 7/1957 | Gehman | 109/50 |
| 3,126,444 | A | * | 3/1964 | Taylor | 174/101 |
| 3,386,393 | A | * | 6/1968 | Peterson et al. | 109/50 |
| 3,717,112 | A | * | 2/1973 | Welty | 109/23 |
| 3,999,493 | A | * | 12/1976 | Gulya | 109/23 |
| 4,043,279 | A | * | 8/1977 | Padgett | 109/50 |
| 4,083,314 | A | * | 4/1978 | Garvin | 109/50 |
| 4,170,120 | A | * | 10/1979 | Feltman et al. | 70/431 |
| 4,278,033 | A | * | 7/1981 | Sobel | 109/59 R |
| 4,419,939 | A | * | 12/1983 | Reverte | 109/54 |
| 4,476,700 | A | * | 10/1984 | King | 70/99 |
| 4,504,103 | A | * | 3/1985 | Woedl | 439/131 |
| 4,535,890 | A | * | 8/1985 | Artusi | 206/530 |
| 4,593,541 | A | * | 6/1986 | Hollis | 70/57 |
| 4,821,652 | A | * | 4/1989 | Hoffman | 109/23 |
| 5,020,450 | A | * | 6/1991 | Lichter | 109/50 |
| 5,243,135 | A | * | 9/1993 | Shotey | 174/67 |
| 5,405,034 | A | * | 4/1995 | Mittel, Jr. | 215/322 |
| 5,586,934 | A | * | 12/1996 | Dombrowski et al. | 454/309 |
| 5,826,922 | A | * | 10/1998 | Wernig | 292/39 |
| 5,877,450 | A | * | 3/1999 | Quin | 174/66 |
| 5,947,038 | A | * | 9/1999 | Smith | 109/50 |

(Continued)

*Primary Examiner* — Lloyd Gall
(74) *Attorney, Agent, or Firm* — Kenneth L Tolar

(57) ABSTRACT

A valuable-storage box includes a hollow housing embedded within a wall having a plurality of sidewalls and an open face in communication with an interior storage chamber. A cover plate securable over the open face includes at least one simulated toggle switch on the front surface that resembles a conventional, operable light switch. Accordingly, when valuables are placed within the storage chamber and the cover plate is fastened, the storage box deceptively resembles an operable light switch.

8 Claims, 3 Drawing Sheets

(56) References Cited

U.S. PATENT DOCUMENTS 6,450,400 B1 * 9/2002 Savoir, Jr. ..... 232/1 D
6,581,424 B2 * 6/2003 Oliver ..... 70/164
6,901,779 B2 * 6/2005 Magee et al. ..... 70/63
8,242,360 B2 * 8/2012 Bercy, Sr. ..... 174/50
2014/0103785 A1 * 4/2014 Richards ..... 312/204

* cited by examiner

CONCEALED VALUABLE-STORAGE BOX

CROSS REFERENCE TO RELATED APPLICATIONS

This application is entitled to the benefit of provisional patent application No. 61/791,016 filed on Mar. 15, 2013, the specification of which is incorporated herein by reference.

BACKGROUND OF THE INVENTION

The present invention relates to a valuable-storage box that deceptively resembles a conventional light-switch plate.

DESCRIPTION OF THE PRIOR ART

Because most people store valuables in a jewelry box that is concealed within a drawer or closet, burglars usually search such locations immediately. Once located, the jewelry box is easily emptied of its contents; even if a jewelry box contains a lock, it can be easily transported to another location and dismantled. Though safes and similar, larger vaults are not typically transportable, they are easy to locate and their locking systems can be compromised by sophisticated thieves.

Accordingly, there is currently a need for a device that more securely conceals valuables. The present invention addresses this need by providing a storage box that resembles an operable, wall-mounted light switch so as to be completely inconspicuous to a burglar.

SUMMARY OF THE INVENTION

The present invention relates to a valuable-storage box comprising a hollow housing embedded within a wall having a plurality of sidewalls and an open face in communication with an interior storage chamber. A cover plate securable over the open face includes at least one simulated toggle switch on the front surface that resembles a conventional, operable light switch. Accordingly, when valuables are placed within the storage chamber and the cover plate is fastened, the storage box deceptively resembles an operable light switch.

It is therefore an object of the present invention to provide a storage box for valuables that is inconspicuously concealed behind a wall.

It is another object of the present invention to provide a storage box for valuables that deceptively resembles an operable light switch.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
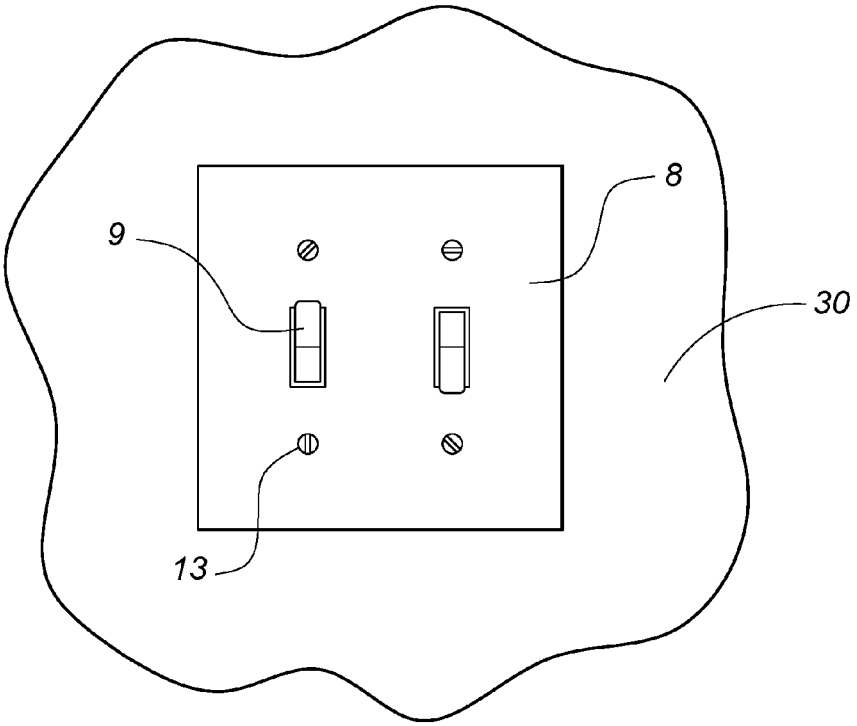
FIG. 1 is a plan view of the storage box according to the present invention installed within a wall.
Figure 2:
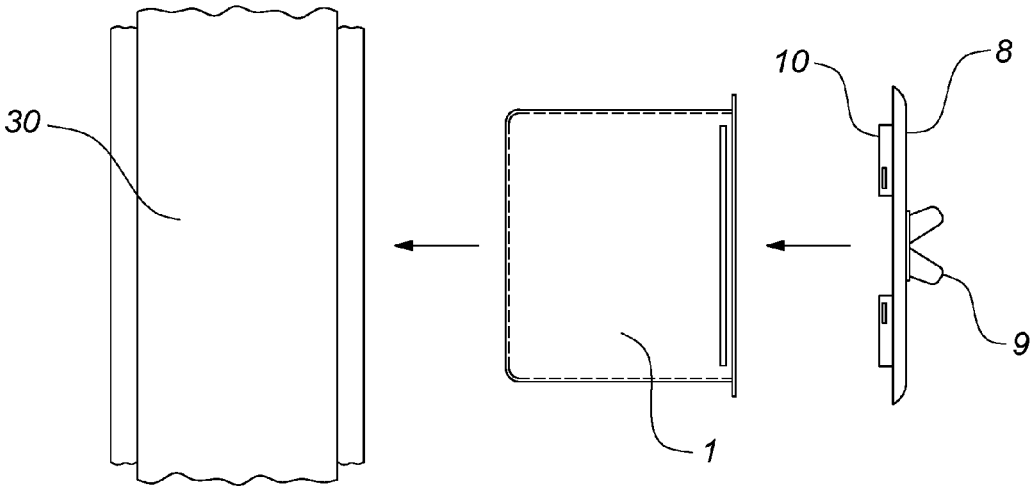
FIG. 2 is a side, exploded view of the storage box offset from an associated wall.
Figure 3:
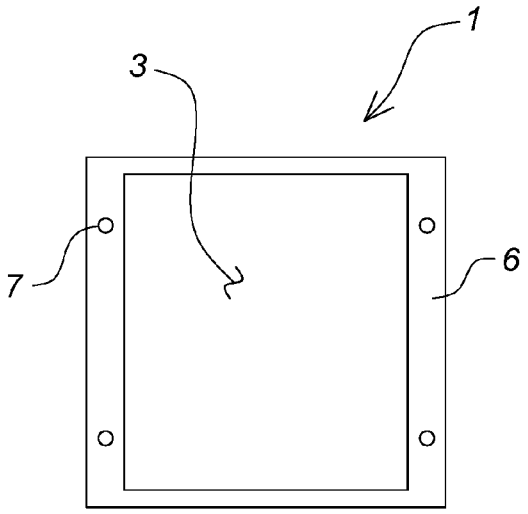
FIG. 3 is an isolated, front view of the housing.
Figure 4:
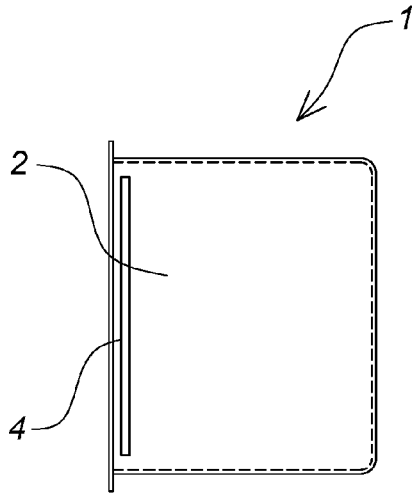
FIG. 4 is an isolated, side view of the housing.
Figure 5:
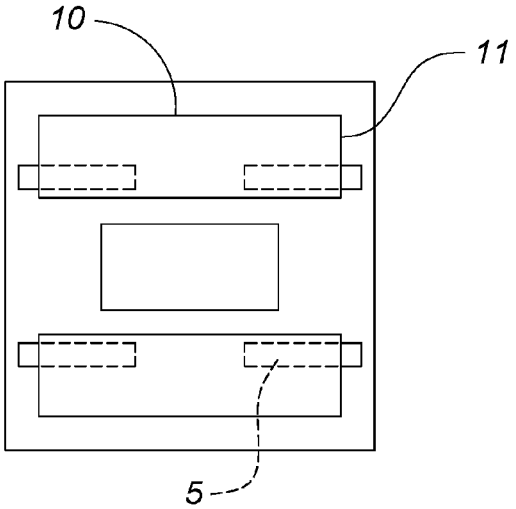
FIG. 5 is an isolated, rear view of the cover plate.

The present invention relates to a valuable-storage box comprising a hollow housing 1 having a plurality of sidewalls 2 and an open face 3 in communication with an interior storage chamber 35. Integrally molded within the inner surface of two opposing sidewalls are slots 4 dimensioned and configured to receive locking latches 5, which are described in more detail below. Surrounding the open face is a peripheral lip 6 having apertures 7 thereon that receive fasteners to secure the housing to a wall.

The device also includes a cover plate 8 having a front surface, a rear surface and multiple peripheral edges. On the front surface is at least one simulated toggle switch 9 that is pivotal upwardly and downwardly similar to a conventional, operable light switch. On the rear surface of the plate are one or more locking modules 10, each including a casing 11 with a latch 5 extending from each of two sides. An actuating screw 13 on the front surface of the cover plate, when rotated, either extends or retracts the latch relative to the casing.

Figure 6:
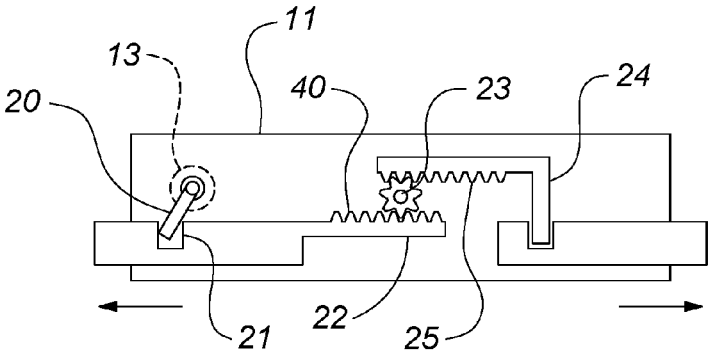
FIG. 6 is an isolated view of the actuating mechanism for extending and retracting the latches.

Now referring specifically to FIG. 6, the actuating screw 13 pivots a shaft 20 received within a cavity 21 on a first one of the latches 5. An inner end 22 of the latch includes a serrated surface 40 that engages a drive gear 23. The opposing latch includes an L-shaped arm 24 having a geared surface 25 that engages an opposing portion of the drive gear. Accordingly, when the screw is rotated in a first direction, the shaft 20 pushes the first latch inwardly, which rotates the drive gear to cause retraction of the opposing latch. Similarly, rotating the screw in an opposite direction extends the two latches.

To install the storage box, a user first cuts a hole in a desired location on an interior wall 30. The hole is dimensioned so that the peripheral lip on the housing engages the surrounding sheet rock to allow fasteners to be inserted through the apertures 7 and anchored to the wall. Alternatively, the hole may be formed adjacent to a stud so that the housing can be fastened thereto. Valuables are placed within the interior storage chamber and the cover plate is superimposed on the open face. The actuating screws are rotated in a first direction to extend the latches into their respective slots to secure the cover plate over the stored valuables. To remove the valuables, the user rotates the actuating screw in an opposite direction to release the cover plate. Accordingly, when the valuables are stored and the cover plate is properly secured, the storage box deceptively resembles an operable light switch.

Figure 7:
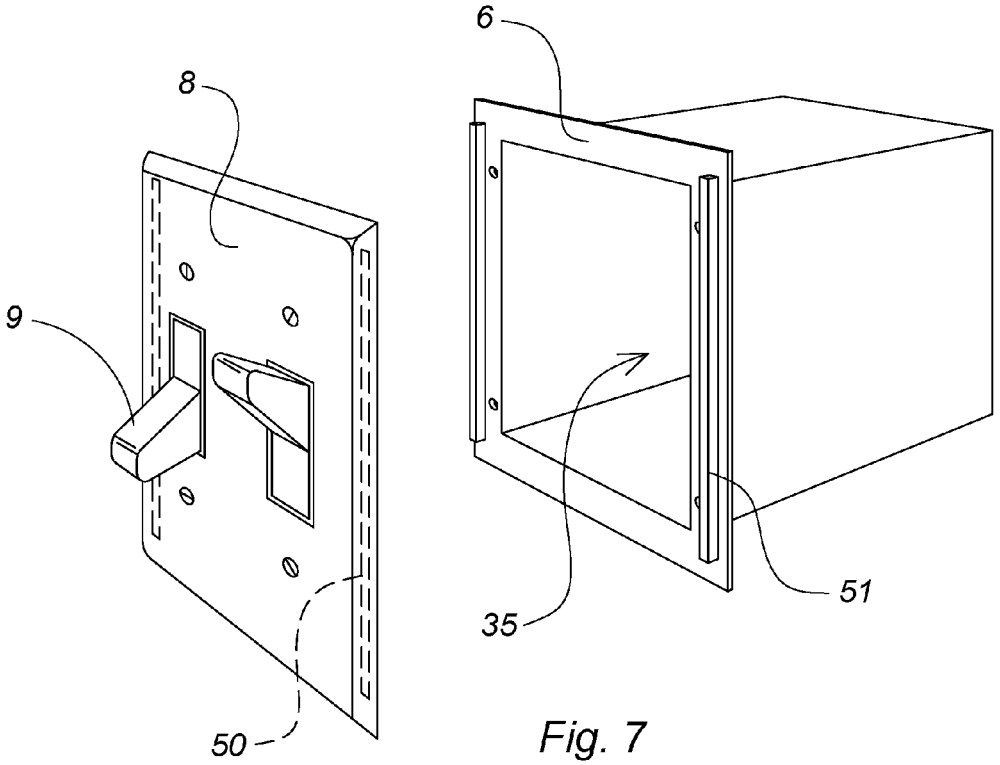
FIG. 7 is a perspective view of a slightly different embodiment of the present invention.

The above-described device is not limited to the exact details of construction and enumeration of parts provided herein. For example, though the cover plate depicted resembles that of a 2-gang switch, it can be configured to resemble a 1, 3 or 4-gang switch. In addition, the cover plate can also be configured to resemble a blank, an electrical-outlet cover plate, a cable or satellite TV jack, vents, smoke detectors, thermostats, clocks, pictures or any other similar wall-mounted item without departing from the spirit of the present invention. The cover plate may also include grooves 50 that slidably engage mating rails 51 on the peripheral lip to secure the plate to the housing in lieu of the locking modules, as depicted in FIG. 7. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a wall having a hole formed therein, a concealed valuable storage box comprising:

a hollow housing received within said hole, said housing having a plurality of sidewalls and an open face in communication with an interior storage chamber;

a cover plate superimposed on said open face, said cover plate having a front surface and a rear surface, said front surface configured to resemble a wall-mounted item;

a peripheral lip surrounding said open face, said lip having rails thereon;

means for locking said cover plate to said housing to secure valuables within said interior storage chamber, wherein said means comprises grooves on the rear surface of said cover plate, said grooves slidably engaging the rails on said peripheral lip to secure said cover plate to said housing.

2. The combination according to claim 1 further comprising:

apertures on said peripheral lip;

fasteners received within said apertures and said wall to secure the housing thereto.

3. The combination according to claim 1 wherein said cover plate is configured to resemble a light-switch plate.

4. The combination according to claim 1 further comprising at least one simulated toggle switch on the front surface of said cover plate, said toggle switch pivotal upwardly and downwardly to mimic an operable light switch.

5. In combination with a wall having a hole formed therein, a concealed valuable storage box comprising:

a hollow housing received within said hole, said housing having a plurality of sidewalls and an open face in communication with an interior storage chamber;

a cover plate superimposed on said open face, said cover plate having a front surface and a rear surface, said front surface configured to resemble a wall-mounted item;

a slot on each of two opposing sidewalls of said housing;

at least one locking module on the rear surface of said cover plate, said locking module having a pair of opposing latches extending therefrom, each of said latches having a cavity formed therein, a first of said latches having a serrated surface;

a rotatable, simulated screw head on the front surface of said cover plate;

a shaft attached to said simulated screw head, said shaft having a portion received within said cavity formed in said first of said latches;

an arm having a geared surface and a portion received within said cavity formed in a second of said latches;

a drive gear engaging said serrated surface and said geared surface whereby when said simulated screw head is rotated in a first direction, the shaft pushes the first of said latches inwardly, which rotates the drive gear to retract the second of said latches, and rotation of the simulated screw head in an opposite direction extends said latches outwardly into said slots to lock said cover plate to said housing.

6. The combination according to claim 5 further comprising:

a peripheral lip surrounding said open face, said lip having apertures thereon;

fasteners received within said apertures and said wall to secure the housing thereto.

7. The combination according to claim 5 wherein said cover plate is configured to resemble a light-switch plate.

8. The combination according to claim 5 further comprising at least one simulated toggle switch on the front surface of said cover plate, said toggle switch pivotal upwardly and downwardly to mimic an operable light switch.

* * * * *